United States Patent [19]

Purssey et al.

[11] Patent Number: 4,815,895

[45] Date of Patent: Mar. 28, 1989

[54] CONSTRUCTION OF TUNNELS OR PIPES FOR USE IN CIVIL ENGINEERING WORKS

[75] Inventors: Ronald Purssey; Robert D. Porteous, both of Queensland, Australia

[73] Assignee: International Manufacturing Pty. Ltd., Queensland, Australia

[21] Appl. No.: 2,630

[22] PCT Filed: Mar. 12, 1986

[86] PCT No.: PCT/AU86/00059

§ 371 Date: Nov. 18, 1986

§ 102(e) Date: Nov. 18, 1986

[87] PCT Pub. No.: WO86/05544

PCT Pub. Date: Sep. 25, 1986

[30] Foreign Application Priority Data

Mar. 19, 1985 [AU] Australia ..... PG9809

[51] Int. Cl.[4] ..... E21D 11/00; F16L 9/22; F16L 9/08

[52] U.S. Cl. ..... 405/153; 405/124; 405/126; 405/134; 405/135; 405/151; 138/155; 138/159; 52/250

[58] Field of Search ..... 405/124–126, 405/132, 134, 135, 150–153, 146; 138/155, 158, 159; 52/250, 251

[56] References Cited

U.S. PATENT DOCUMENTS 1,860,533 5/1932 Fredenhagen ..... 138/159 X

FOREIGN PATENT DOCUMENTS 892301 3/1962 United Kingdom ..... 405/152
1502207 2/1978 United Kingdom ..... 405/151
2026064 1/1980 United Kingdom .
1585770 3/1981 United Kingdom ..... 405/152
2055413 3/1981 United Kingdom ..... 405/153

*Primary Examiner*—Randolph A. Reese
*Assistant Examiner*—John A. Ricci
*Attorney, Agent, or Firm*—Arnold, White & Durkee

[57] ABSTRACT

A tunnel or pipe section which includes a plurality of panels which are connected together to form a closed tunnel or pipe section. Each panel includes a plurality of tubular connectors which are anchored within the panel, preferably to the reinforcing members of the concrete panels, and which are connected to one another, such as by bolting through apertures in walls of the aligned connectors.

4 Claims, 4 Drawing Sheets

CONSTRUCTION OF TUNNELS OR PIPES FOR USE IN CIVIL ENGINEERING WORKS

The present invention relates to the construction of tunnels or pipes for use in civil engineering works, and more particularly to the construction of box culverts.

Box culverts are conventionally fabricated from reinforced concrete in the form of complete pipe sections, for example of rectangular form. Considerable expertise is involved in the casting of these sections, and the cast sections themselves are bulky and give rise to difficulties in transportation to the site and handling on the site.

According to the present invention there is provided a tunnel or pipe section comprising a plurality of building panels connected to form a closed figure, wherein each panel comprises a plurality of tubular connectors anchored within the panel and secured to connectors of the or each adjacent panel by securing means extending through apertured walls of the aligned connectors.

Embodiments of the invention will now be described, by way of example only, with reference to the accompanying drawings in which.

Figure 1:
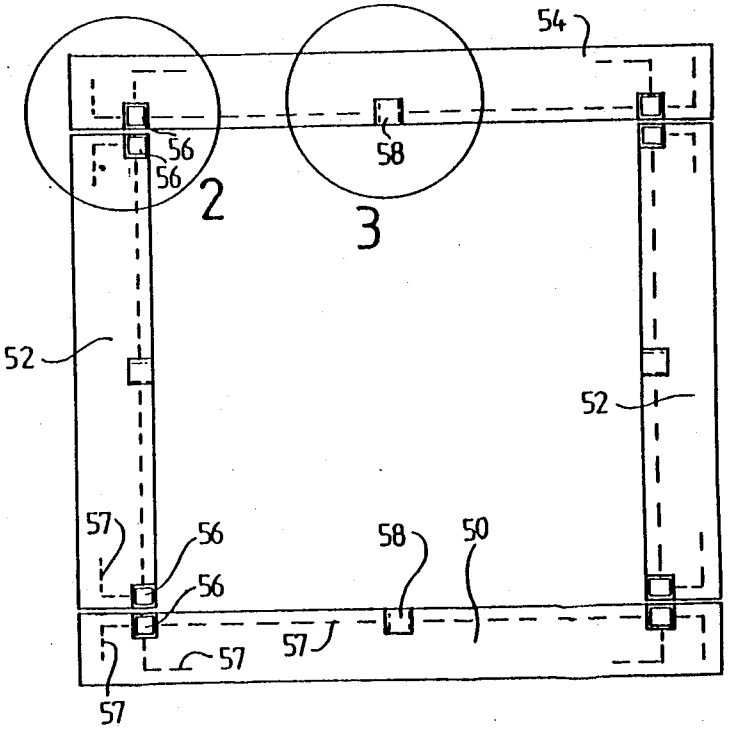
FIG. 1 is a front elevation of a tunnel or pipe section formed by several connected panels.

FIG. 1 shows a tunnel or pipe section of square or other rectangular form constituted by a base panel 50, two upright, opposed, side wall panels 52, and a roof panel 54, the panels each being of rectangular form and each preferably being of reinforced concrete. The adjacent panels in the section are connected by bolting together tubular connectors 56 of square or other rectangular section arranged with their longitudinal axis aligned in the length direction of the panel. The respective side walls of each connector 56 are provided with holes, slots, or other apertures to receive the end portion of anchoring means 57 by which the connector is anchored within the panel or to receive a bolt by which the adjacent connectors of adjacent panels are bolted together, the apertures being in the central portion of each respective side wall. The anchoring means 57 are preferably constituted by the threaded reinforcing rods of the panel which extend into the connector through the holes and which carry nuts to secure the connector. Alternatively, the anchoring means may comprise bolts welded or otherwise fixed to the reinforcing rods.

Figures 2, 3:
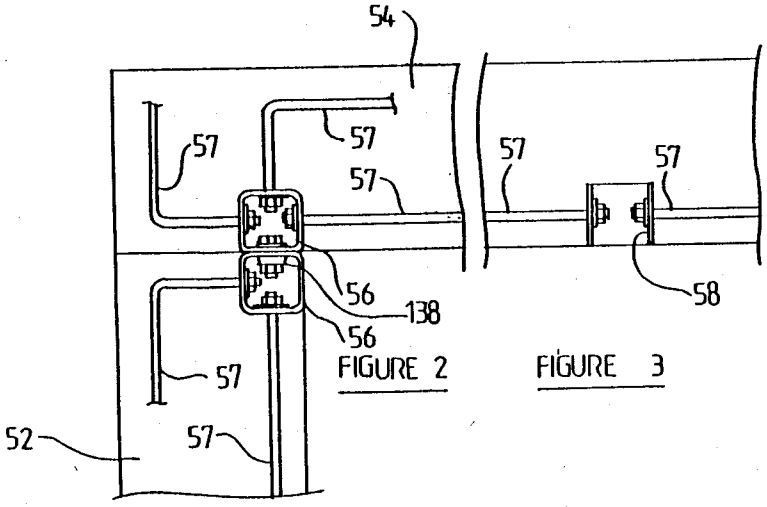
FIG. 2 shows, to an enlarged scale, a detail of a connection marked '2' in FIG. 1.
FIG. 3 shows, to an enlarged scale, a detail of a connector marked '3' in FIG. 1.
Figure 4:
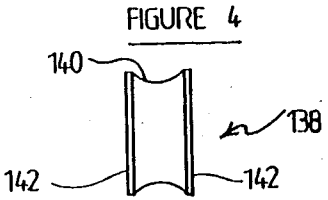
FIG. 4 is a side elevation of a resilient washer incorporated in the connections between adjacent panels shown in FIGS. 2 and 3.

The connection between two adjacent panels in the tunnel or pipe section is shown in detail in FIG. 2, with the adjacent abutting faces of the two connectors being bolted together. Preferably, and as shown in FIG. 2, a resilient washer 138 is used in the bolted connection. Such a resilient washer is shown in FIG. 4 and comprises a laminate consisting of an annular body 140 of rubber, plastics or other resiliently compressible material, sandwiched between outer washers 142 of metal or plastics, the washers, when of metal, being galvanised or otherwise resistant to corrosion.

Reinforced concrete panels are often erected while the concrete is still in a green state, with the result that the panels tend to contract during curing, while they are in situ within the structure. In addition, after curing the panels are subject to thermal expansion and contraction. The resilient washers 138 permit contraction upon curing, and subsequent thermal expansion and contraction, without the panels cracking within the structure.

The tubular connectors shown in FIGS. 1 and 2 lie adjacent one axial end of the tunnel or pipe section and open onto that end to provide access for insertion of the connecting bolts, similar connectors being provided at the other axial end in order to connect the adjacent panels also at the other end. If required, tubular connectors may also be provided at one or more positions along the axial length of the panel. It will be noted from FIGS. 1 and 2 that the connectors 56 lie immediately adjacent the inner faces of the panels and extend only part way into the thickness of the panel, for example into $\frac{1}{3}$ or $\frac{1}{2}$ of the panel thickness.

Figure 5:
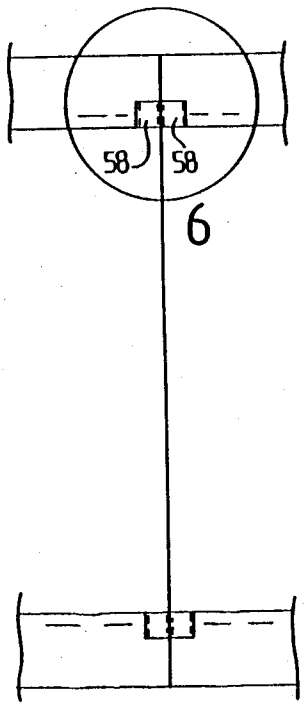
FIG. 5 is a fragmentary side elevation showing two abutting tunnel or pipe sections of the type shown in FIG. 1.
Figure 6:
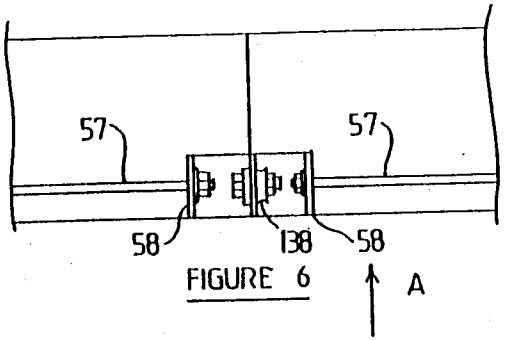
FIG. 6 shows to an enlarged scale a detail of a connection marked '6' in FIG. 5, and formed by two connectors as shown in FIG. 3.
Figure 7:
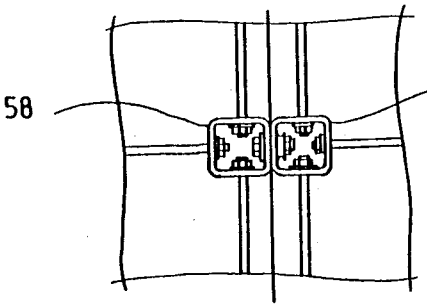
FIG. 7 is an elevation in the direction of arrow 'A' in FIG. 6.

In FIG. 1, a connector 58 is shown at an intermediate position along the width of each panel with the connector being orientated so that its axis is perpendicular to the length of the panel and so that it opens onto the inner face of the panel. One such connector 58 is shown in detail in FIG. 3 and these connectors serve to join adjacent tunnel or pipe sections as shown in FIGS. 5 to 7. Although in FIG. 1 a single such connector 58 is shown placed centrally along the width of each panel, the connector may be placed at any required position along the width of the panel, and each panel may incorporate more than one such connector, if required. Resilient washers 138 of the type shown in FIG. 4 may be incorporated in the bolted connections between the adjacent tunnel or pipe sections, as required, possibly with a resilient gasket being interposed between the adjoining edges of adjacent sections.

When required, a suitable seal is incorporated between the adjoining edges and/or faces of the panels in each section, and between the adjoining edges of adjacent sections in order to provide a waterproof structure. When a resilient gasket is incorporated between the adjoining edges of adjacent sections as discussed above, the gasket may also serve to provide a seal against water penetration.

Figure 8:
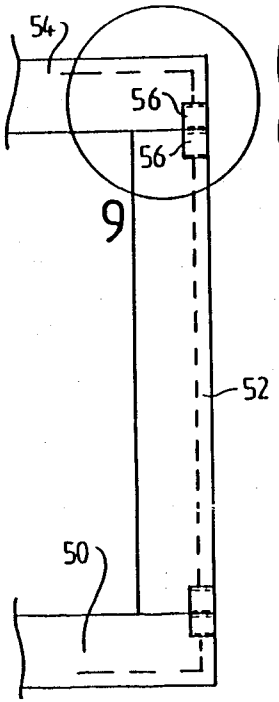
FIG. 8 is a fragmentary front elevation of a tunnel or pipe section similar to that of FIG. 1, but assembled by means of connectors differently arranged in the panels.
Figure 9:
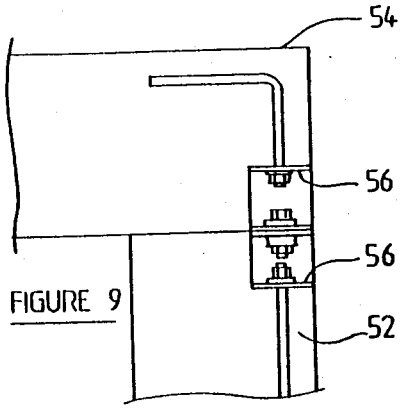
FIG. 9 shows, to an enlarged scale, a detail of a connection marked '9' in FIG. 8.

FIGS. 1 to 7 show a tunnel or pipe section assembled by means of tubular connectors adjacent the internal faces of the panels. FIGS. 8 and 9 show a similar tunnel or pipe section assembled by means of similar tubular connectors, but instead located adjacent the external faces of the panels. In this configuration, the tubular connectors of the base and roof panels are placed with their longitudinal axes aligned in the width direction of these panels, and the connectors of the side wall panels are placed with their longitudinal axes perpendicular to the plane of these panels. In all other respects, the discussion concerning FIGS. 1 to 7 is applicable also to FIGS. 8 and 9.

A box culvert produced from a pipe section as shown in FIGS. 1 to 9 can be easily assembled on site from flat panels which may either be cast on site or pre-cast and then transported to site, the transportation and handling costs of pre-cast panels being substantially less than that of pre-formed box culverts. The casting of flat panels is also considerably easier than casting complete box culverts.

Figure 11:
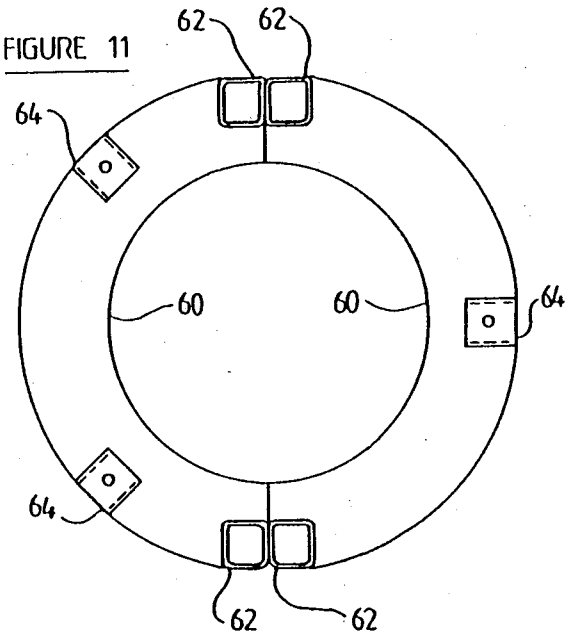
FIG. 11 is a front elevation showing a tunnel or pipe section similar to that of FIG. 10, but with the building panels assembled by means of differently arranged connectors.
Figure 10:
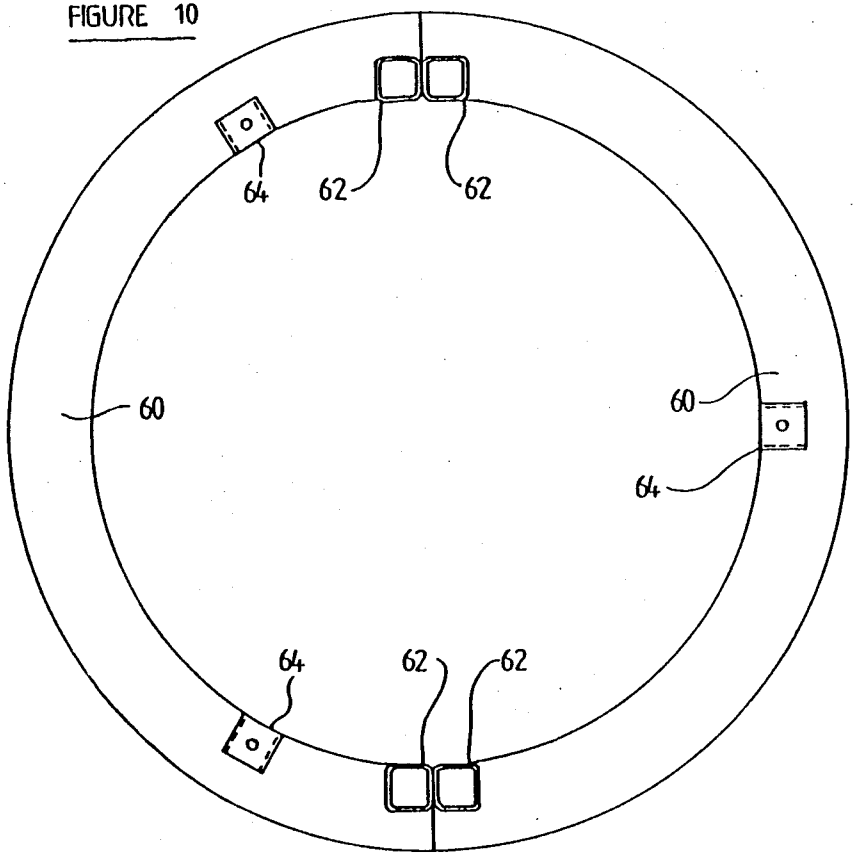
FIG. 10 is a front elevation of a tunnel or pipe section of circular form composed of curved building panels.

FIGS. 1 to 9 show the construction of a tunnel or pipe section of square or other rectangular form. FIGS. 10 and 11 show a tunnel or pipe section of circular form. The section comprises two semi-circular panels 60 preferably composed of reinforced concrete and bolted together using rectangular tubular connectors 62 of the type previously described and anchored within the panels in the manner previously described. In FIG. 10, the connectors 62 are arranged adjacent to the internal faces of the panels 60 and are arranged with their longitudinal axes aligned in the length direction of the panels similarly to the arrangement shown in FIGS. 1 and 2, the connectors 62 being incorporated at each axial end of the panels 60.

The adjacent circular tunnel or pipe sections are bolted together using rectangular tubular connectors 64 arranged at one or more intermediate positions around the inner periphery of the panels, the connectors 64 being arranged with their longitudinal axes aligned with the radial direction of the panels 60 in order to provide a bolted connection of the type shown in FIGS. 6 and 7. Resilient washers of the type shown in FIG. 4 may be incorporated in the bolted connections between adjacent panels, and between adjacent sections, if required. The construction shown in FIG. 11 differs from that of FIG. 10 only in that the connectors 62, 64 are placed adjacent the external face of the panels 60. In a modified arrangement, the connectors may extend through the entire thickness of the panels.

In FIGS. 10 and 11, a circular tunnel or pipe section is produced from two semi-circular panels. It will be appreciated, however, that the circular section could also be produced by three or more curved panels of appropriate angular extent. The section need not necessarily be in the form of a circular section. By using panels of appropriate curvature, elliptical, ovoidal or other curved sections may be formed. It would also be possible to produce a section of curvilinear form, for example comprising a planar base panel and one or more arcuate or other curved panels supported from the base panel.

The tubular connectors described hitherto have been of square or other rectangular cross-section. However, this is not essential and the connectors may be of other cross-section.

The tubular connectors of any desired cross-section can be fabricated from metal or plastics, according to requirements. For many applications the connectors will be of roll-formed steel, although they may alternatively be of extruded aluminium or extruded plastics where strength considerations permit. As discussed earlier, the walls of the tubular convectors are apertured with holes, particularly circular holes, or elongate slots, to receive the end portions of the anchoring means by which the connectors are anchored within the panels and to receive the connecting bolts by which two adjacent panels are secured. The slots, if present, permit a degree of adjustability and may also facilitate insertion of the connecting bolt. Adjustability may also be provided by forming each side of the connector with a plurality of apertures to selectively receive the connecting bolt or anchoring means.

As will be apparent from the foregoing, tubular connectors of any desired configuration may be anchored to the panels at any desired position either to provide a connection between adjacent panels, to connect a panel to another part of a structure, or to attach a component to the panel. The connectors may extend through the entire thickness of the panel or only through part of the thickness of the panel; in this latter regard, the connectors may be adjacent the inner or outer surface of the panel as has been illustrated, or they may be offset inwardly from both surfaces of the panel.

A connector capable of resisting seismic loading, may be produced by reinforcing a tubular connector with an internal plate which closes the cross section of the connector in close proximity to the apertures in the connector walls.

The tunnel or pipe sections described permit reduced costs in fabrication and assembly. The tubular connectors permit the panels within each section to be easily connected while providing a secure and reliable connection.

The various embodiments of the invention have been described by way of example only, and modifications are possible within the scope of the invention.

We claim:

1. A tunnel or pipe section comprising a plurality of rectangular panels assembled together to form a closed figure, wherein each panel is of concrete reinforced by reinforcement comprising reinforcing rods of threaded form, at least some of the panels having embedded into the edges connectors which lie adjacent corresponding connectors of adjacent panels whereby adjacent panels of the section can be connected by bolting the adjacent connectors, wherein the connectors are of tubular form and of rectangular cross-section with four side walls, each of said side walls including an aperture intermediate the ends of the connector, some of said apertures receiving end portions of the threaded reinforcing rods whereby the ends of the rods lie within the interior of the connectors, and nuts on the threaded ends of the connectors, said nuts lying within the interior of the connectors whereby the connectors are anchored within the panels by being secured directly to the reinforcing rods, another one of said apertures and the corresponding side wall of the connector lying at the edge of the panel with the said side wall being substantially flush with the panel edge so as to lie in face-to-face relationship with the apertured side wall of a corresponding adjacent connector in an adjacent panel, the two adjacent connectors being bolted together by a bolted connection comprising a bolt extending between the facing side walls.

2. A tunnel or pipe section according to claim 1 wherein the panels are planar.

3. A tunnel or pipe section according to claim 1, wherein the panels are of curved cross-section.

4. A tunnel or pipe section according to claim 1, wherein the bolted connection comprises resilient means enabling expansion and contraction of the panels.

* * * * *